US005593500A

United States Patent [19]

König et al.

[11] Patent Number: 5,593,500

[45] Date of Patent: Jan. 14, 1997

[54] DEVICE FOR COATING SOLID PARTICLES

[75] Inventors: Axel König, Stuttgart; Matthias Kleinhans, Waiblingen; Janéz Michelic, Remseck, all of Germany

[73] Assignee: Santrade Ltd., Lucerne, Switzerland

[21] Appl. No.: 397,134

[22] PCT Filed: Aug. 5, 1994

[86] PCT No.: PCT/EP94/02608

§ 371 Date: May 2, 1995

§ 102(e) Date: May 2, 1995

[87] PCT Pub. No.: WO95/07135

PCT Pub. Date: Mar. 16, 1995

[30] Foreign Application Priority Data

Sep. 10, 1993 [DE] Germany ..... 43 30 632.2

[51] Int. Cl.[6] ..... B05C 5/00

[52] U.S. Cl. ..... 118/303; 366/293; 366/295

[58] Field of Search ..... 118/303; 427/212; 366/293, 295, 296; 239/665, 666, 667, 682, 683, 687

[56] References Cited

U.S. PATENT DOCUMENTS 3,269,660 10/1965 Graham ..... 239/224

4,690,834 9/1987 Appelgram et al. ..... 427/212

5,132,142 7/1992 Jones et al. ..... 118/303

5,284,678 2/1994 Hirschfeld et al. ..... 118/303

FOREIGN PATENT DOCUMENTS 0048312 3/1982 European Pat. Off. .

*Primary Examiner*—Laura Edwards

*Attorney, Agent, or Firm*—Burns, Doane, Swecker & Mathis, L.L.P.

[57] ABSTRACT

A device is disclosed for improved coating of small solid particles with a melt of a material which solidifies at room temperature. The device includes a rotatable turbine body having two rotatable disk parts. An annular gap is provided between the rotatable disk parts which allows the melt to emerge to coat the solid particles in an annular space. The two rotatable disk parts are connected by a fine-pitch thread which allows the size of the annular gap to be adjusted by rotating one of the disks relative to the other. Rotation of one of the disks is performed from the exterior of the device by an adjusting pin which eliminates the need to dismantle the device to adjust the flow of the coating material.

14 Claims, 2 Drawing Sheets

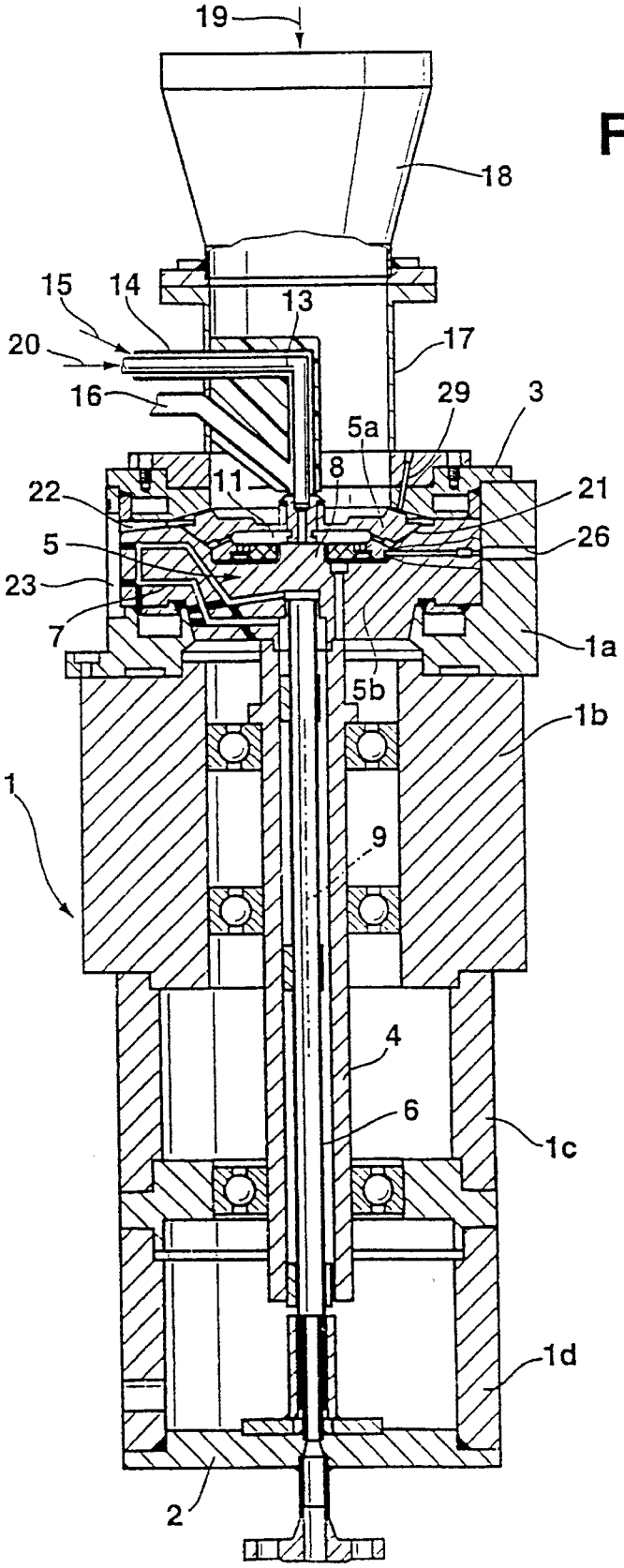
Fig. 1
Fig. 4
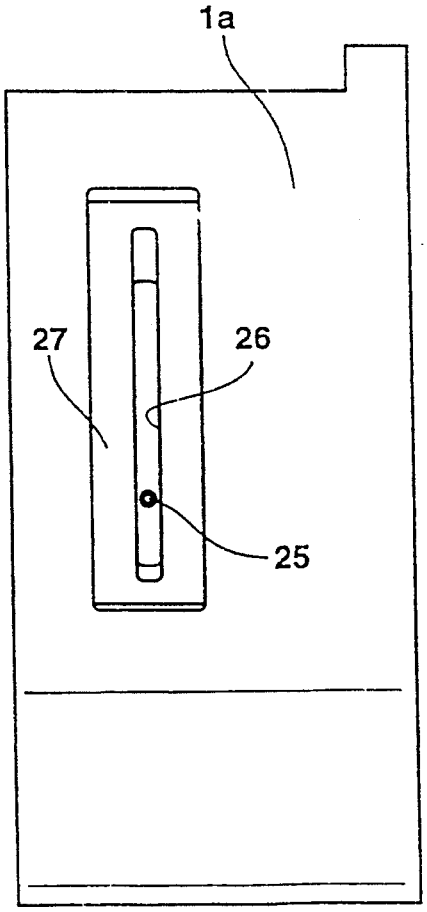

DEVICE FOR COATING SOLID PARTICLES

BACKGROUND OF THE INVENTION

The present invention relates to a device for coating solid particles with a solidifying layer derived from a liquid, molten material. The device includes a turbine which rotates in a housing and comprises two disk parts. The solid particles are supplied on one surface of one disk part while the molten liquid material is supplied in a hollow space located between the two disk parts. The liquid flows through an annular gap between the disk parts and into an annular space in the housing that carries the solid particles which have been spun off to the outside, for the purpose of coating the solid particles.

A device of this type has been known, for example, from EP 0 048 312 A1. In this device, the two disk parts forming the turbine are in mutual axial contact by blade ribs extending from the upper disk part in a downward direction into the hollow space, and forming between them flow channels for the liquid, normally a melt, that is thereby guided into the annular gap. If the delivery quantity of the molten material is to be varied, for example for obtaining different droplet sizes in the coating veil, then the turbine must be removed and replaced by another turbine having a different size annular gap, or spacers must be provided that vary the spacing between the disk parts. In both cases it is necessary to remove the turbine from the housing.

SUMMARY OF THE INVENTION

Therefore, it is an object of the present invention to design a device of the before-mentioned type in such a way that the height of the annular gap can be varied without the need to remove the turbine. For the purpose of achieving this object with a device of the before-mentioned type, a device is provided which enables the size of the annular gap to be adjusted the two disk parts which are arranged to be axially adjustable one relative to the other from the outside. According to a further improvement of the invention, this can be achieved in a particularly simple and advantageous way if the axial adjustment is effected by a central thread connecting the two disk parts, especially a fine-pitch thread, and if there are provided means that can be operated from the outside of the housing for rotating the disk parts one relative to the other, and means for fixing the relative positions of the disk parts. With this embodiment, a relative rotation of the disk parts, that can be effected from the outside, is sufficient to effect a desired, normally only insignificant, variation of the annular gap.

According to a further development of the invention, the rotating means are constituted by an adjusting pin which projects through a slot, that extends over part of the circumference of the housing, and which engages radially a first disk part, while the second disk part is advantageously provided with a protection against rotation. Thus, it is only necessary to stop the turbine and, after removal of a locking means, to rotate the two disk parts one relative to the other by a given angle, whereby they are axially adjusted in the desired way via the fine-pitch thread.

According to a further development of the invention, the protection against rotation consists of a locking pin that projects through a housing cover and is supported on the surface of the second disk part. The means for fixing the relative positions of the two disk parts may consist in this case of a locking pin engaging the disk parts in radial direction.

According to a further, particularly advantageous embodiment of the invention, the locking pin may be screwed radially into a thread provided in the second disk part, and the adjusting pin may be arranged for axial and non-rotatable connection with the locking pin. This feature enables the locking pin to be initially moved out of its locking position by means of the adjusting pin that has been introduced from the outside, for effecting the adjustment. Thereafter, once the protection against rotation for the second disk part has been mounted, the desired adjustment can be effected. Finally, the locking pin is screwed in again, and the turbine can re-commence production, without there having been any need to remove the turbine or to carry out any change-over work.

Given the fact that in the case of the embodiment according to the invention the two disk parts can be displaced in axial direction, one relative to the other, while conveniently a supply pipe connection for the melt, effecting a uniform distribution of the liquid and being firmly connected with an external supply pipe, projects into the hollow space in the turbine, a further advantageous development of the invention provides that the supply pipe connection is arranged so as to permit a sliding movement in axial direction in a central collar of the second disk part. Finally, a labyrinth packing may be arranged between the collar and the supply pipe connection so that the supply of the melt constituting the liquid can be effected in the proven way, while simultaneously providing for the adjustability of the annular gap.

BRIEF DESCRIPTION OF THE DRAWINGS

One practical embodiment of the invention is illustrated in the drawing and will be described hereafter. In the drawing:

FIG. 1 is a diagrammatic longitudinal section through a device according to the invention;

FIG. 3 is a top view of part of the device, as illustrated in FIG. 2, cut in part along line III*a*—III*a;* and FIG. 4 is a side view of the part of the housing shown in FIG. 3, viewed in the direction of arrow IV.

FIG. 1 shows a device for coating solid particles consisting essentially of a tubular housing (1), built up in the illustrated embodiment from four housing rings (1*a*, 1*b*, 1*c* and 1*d*). Supported in this housing (1), which is closed at its top and at its bottom by covers (2 and 3, respectively), is a drive shaft (4), designed as hollow shaft, for a turbine (5) which is set into rotation via a drive system in a manner not shown in detail. Inside the hollow shaft (4), there is arranged, at a distance to the inner diameter of the hollow shaft (4), another pipe (6) which is fixed to the turbine and which serves for supplying the turbine body with a heating agent, for circulation through channels arranged in the turbine body.

Figure 2:
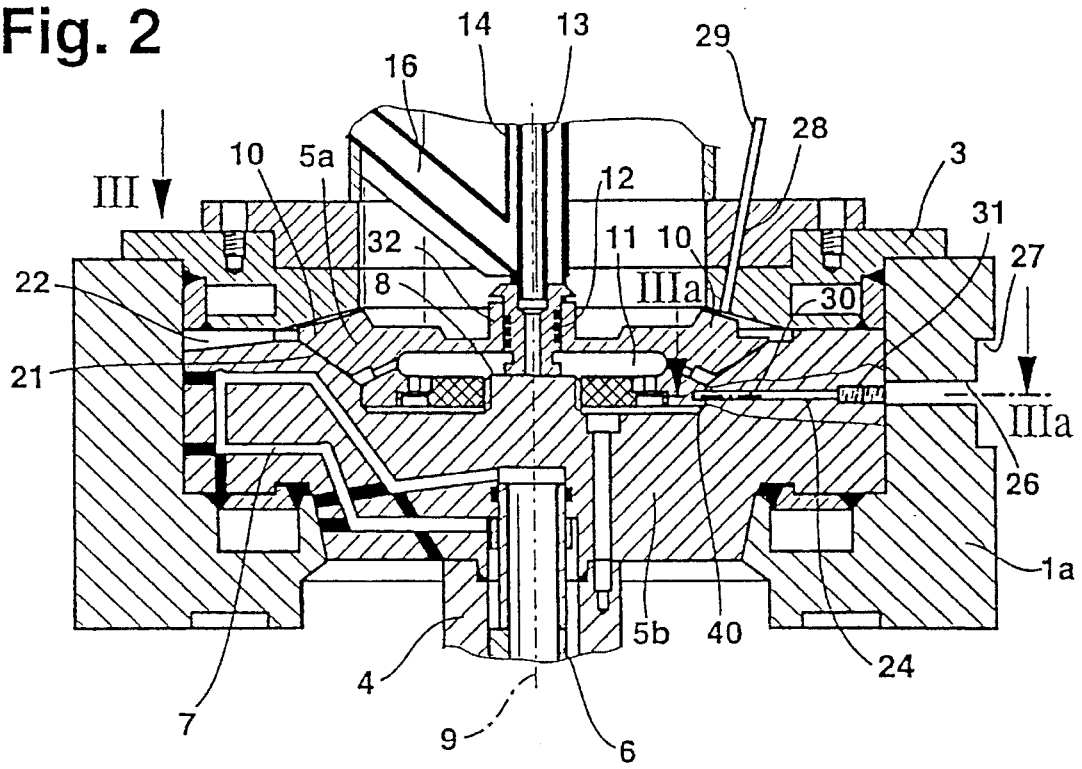
FIG. 2 is an enlarged view of the housing portion of the device according to FIG. 1 that contains the turbine.

The turbine (5) consists of two disk parts (5*a* and 5*b*), the disk part (5*b*) being connected to the hollow shaft (4) and the pipe (6) and comprising also the heating channels (7). As can be seen in full detail in FIG. 2, the disk part (5*b*) is equipped with a threaded pipe (8) having a fine-pitch thread. Screwed onto this threaded pipe (8), that extends coaxially to the axis of rotation (9) of the turbine, is a disk part (5*a*) which comprises on its surface the radially extending blades (10), shown in sectional representation in the figure, and in its interior a hollow space (11). The disk part (5A) can be guided relative to the disk part (5*b*) via a close fit. The disk part (5*a*) is connected with the supply pipe (13) via a supply pipe connection (12), as shown in FIG. 2. A lower end of the supply pipe (13) extends coaxially to the supply pipe connection (12). The supply pipe connection (12) is guided for axial displacement in a collar (32) projecting in upward direction from the middle of the disk part (5*a*). A labyrinth packing is provided between the supply pipe connection (12) and the collar (32). The supply pipe (13) is surrounded by a heating jacket (14), through which a heating agent is introduced in the direction of arrow (15) for being removed later through a second pipe (16).

A cylindrical pipe (17) with a funnel (18), fitted centrally in the cover (3) having a two-part design, serves in a manner not shown in detail for feeding the solid particles to be coated onto the surface of the disk part (5*a*). The compound needed for coating the solid particles is introduced as a melt, in a heated condition, through the pipe (13) and into the space (11), in the direction indicated by the arrow (20), from where it can enter an annular gap (21) via radially extending bores. The solid particles are spun off the blades (10) radially to the outside, into an annular space (22) where they are coated by the melt. The melt emerges from the annular gap (21) forms sort of a veil. The coating is then cooled, whereby it solidifies.

Figure 3:
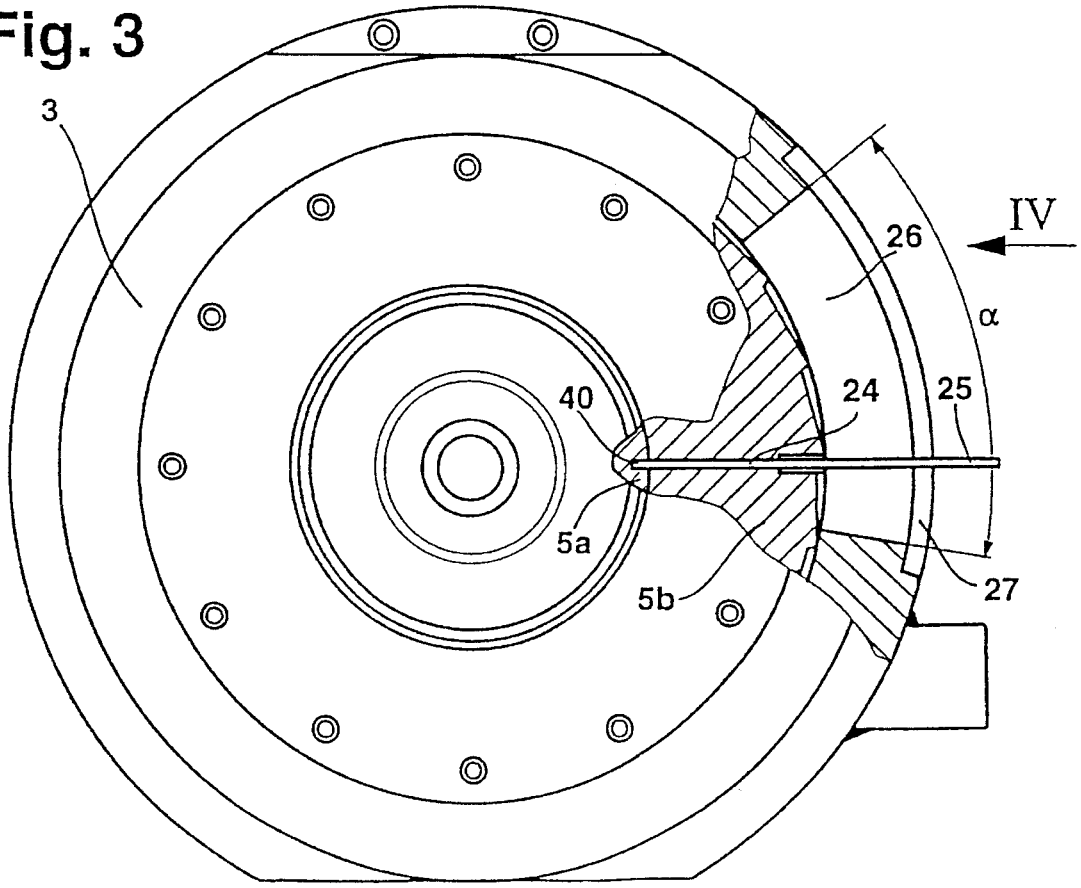

In order to enable the height of the annular gap to be adjusted from the outside, without having to remove the turbine, the illustrated embodiment comprises a radial bore (24) in the disk part (5*b*)—as can be seen best in FIGS. 2 and 3—into which an adjusting pin (25) can be radially introduced through a housing slot (26) provided in the housing part (1*a*). The slot (26) extends through at an angle $\alpha$ of approximately 50° in the circumferential direction of the housing ring (1*a*) and in the circumferential direction of the turbine (5)—see FIG. 3. The slot (26) terminates externally by a large recess (27) for improved accessibility.

In addition, it can be seen in FIGS. 1 and 2 that the cover (3) is provided with a bore (28) starting at the top of the disk part (5*a*) in such a way that a locking pin (29) can be introduced from above, and extending with its lower end into the space between the radially extending blades (10). This locking pin (29) fixes the disk portion (5*a*) against rotation. Now, when the adjusting pin (25) is pivoted in counter-clockwise direction within its slot (26), from its position illustrated in FIG. 3, this has the effect to rotate the disk part (5*b*) relative to the fixed disk part (5*a*). This has the result that the disk part (5*a*) is adjusted in axial position relative to the disk part (5*b*), due to its being engaged by the thread of the pipe connection (8), which is a a fine-pitch thread. During the adjustment, the adjusting pin (25) occupies a position in which it does not engage the disk part (5*a*). This leads to the situation that the height of the annular gap (21) changes as the adjusting pin is pivoted. Once the desired height of the annular gap is adjusted, the adjusting pin (25) is retracted from its bore (24) and replaced by another locking pin (30), as shown in FIGS. 1 and 2. The locking pin (30) comprises a threaded head, which may be screwed into a matching thread of the bore (24). During this threading-in operation, an opposite end of the locking pin (30) engages one of the plurality of blind bores (40) arranged radially on the outer periphery of the disk part (5*a*) and distributed uniformly over the periphery of the disk part (5*a*) at given angular spacings. This has the effect to secure the two disk parts (5*a* and 5*b*) in their position relative one to the other.

If after a certain operating phase the annular gap (21) is to be adjusted, one retracts the locking pin (30) from the blind bore (40) in the disk part (5*a*), and once the adjusting pin (25) has been inserted, another adjustment can be effected without the need to remove the turbine (5).

A particularly convenient and simple solution is obtained when that end of the locking pin (30) that carries the threaded head (31) is provided for example with an internal hexagon for introduction of a hexagonal end of the adjusting pin (25). The adjusting pin and the locking pin then form together one adjusting pin, when the locking pin (30) has been removed from its locking position by actuation through the adjusting pin. In the case of this embodiment it is not necessary for the locking pin (30) to be removed completely from the disk body (5*b*) every time an adjustment is to be made. However, it is a precondition for this embodiment of the invention that the axial distance necessary for removing the locking pin (30) from the bores (40) of the disk part (5*a*) is available for the head (31) of the locking pin (30) within the disk part (5*b*).

We claim:

1. A device for coating solid particles with a coating material which is solid at room temperature comprising:

a housing;

a rotatable turbine body mounted within the housing, said rotatable turbine body including a first disk and a second disk which form an annular gap between adjacent surfaces of the first and second disks;

a first conduit within the housing for delivering a melt of the coating material to the annular gap between the disks and into an annular space in the housing;

a second conduit within the housing for delivering the solid particles to be coated to a surface of the first disk opposite the annular gap so that the solid particles are spun off into the annular space; and adjusting means operably connected to the turbine body for adjusting the size of the annular gap between adjacent surfaces of the first and second disks from an outside of the housing.

2. The device according to claim 1, wherein the adjusting means comprises a central thread connecting the first and second disks, actuating means for rotating one of the first and second disks relative to the other, and fixing means for fixing the relative positions of the first and second disks.

3. The device according claim 2, wherein the actuating means comprises an adjusting pin for radially engaging one of the first and second disks, said adjusting pin projecting through a slot in the housing that extends over part of the circumference of the housing.

4. The device according to claim 3, wherein the adjusting pin engages the second disk and extends to the outside of the housing.

5. The device according to claim 2, wherein the fixing means for fixing the relative positions of the first and second disks consist of a locking pin engaging both the first and second disks in a radial direction.

6. The device according to claim 5, wherein the locking pin can be screwed into a threaded bore provided in one of the first and second disk parts.

7. The device according to claim 6, wherein the adjusting means is arranged for axial and non-rotatable connection with the locking pin.

8. The device according to claim 2, wherein the central thread connecting the first and second disks is a fine-pitch thread which allows fine adjustments of the size of the annular gap.

9. The device according to claim 1, wherein the adjusting means includes protection means in communication with the first disk for preventing rotation thereof.

10. The device according to claim 9, wherein the protection means comprises a locking pin that projects through a housing cover and is supported on the surface of the first disk part.

11. The device according to claim 1, wherein the first conduit is provided with a supply pipe connection, which is connected with the first conduit for delivering the melt, the supply pipe connection is arranged so as to permit sliding movement in an axial direction within a central collar of the first disk.

12. The device according to claim 11, wherein a packing is arranged between the collar of the first disk and the supply pipe connection.

13. The device according to claim 1, wherein said adjusting means is removably attachable to said turbine body.

14. The device according to claim 1, wherein said adjusting means includes an inner end connected to said turbine body and an external end exposed to the exterior of said housing.

* * * * *